US010365569B2

(12) United States Patent
Tokimitsu et al.

(10) Patent No.: US 10,365,569 B2
(45) Date of Patent: Jul. 30, 2019

(54) ELECTROPHOTOGRAPHIC PHOTOSENSITIVE MEMBER, PRODUCTION METHOD OF ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Ryoichi Tokimitsu, Kashiwa (JP); Masaki Nonaka, Toride (JP); Haruki Mori, Ichikawa (JP); Takahiro Mitsui, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/053,905

(22) Filed: Aug. 3, 2018

(65) Prior Publication Data

US 2019/0049867 A1 Feb. 14, 2019

(30) Foreign Application Priority Data

Aug. 10, 2017 (JP) ..... 2017-155635

(51) Int. Cl.

| | |
|---|---|
| ***G03G 5/00*** | (2006.01) |
| ***G03G 5/07*** | (2006.01) |
| ***G03G 5/05*** | (2006.01) |
| ***G03G 5/06*** | (2006.01) |
| ***G03G 5/147*** | (2006.01) |

(52) U.S. Cl.

CPC ..... *G03G 5/07* (2013.01); *G03G 5/0525* (2013.01); *G03G 5/0592* (2013.01); *G03G 5/0601* (2013.01); *G03G 5/147* (2013.01); *G03G 5/14708* (2013.01); *G03G 5/14734* (2013.01)

(58) Field of Classification Search

CPC ..... G03G 5/14708; G03G 5/14734

USPC ..... 430/66

See application file for complete search history.

(56) References Cited

U.S. PATENT DOCUMENTS

| | | | |
|---|---|---|---|
| 7,186,489 | B2 | 3/2007 | Uematsu et al. |
| 7,226,711 | B2 | 6/2007 | Amamiya et al. |
| 7,333,752 | B2 | 2/2008 | Kawahara et al. |
| 7,534,534 | B2 | 5/2009 | Nakata et al. |

(Continued)

FOREIGN PATENT DOCUMENTS

| | | | |
|---|---|---|---|
| JP | 2000-066425 | A | 3/2000 |
| JP | 2016-090593 | A | 5/2016 |

OTHER PUBLICATIONS

U.S. Appl. No. 15/969,836, Haruki Mori, filed May, 3, 2018.

(Continued)

*Primary Examiner* — Mark A Chapman

(74) *Attorney, Agent, or Firm* — Venable LLP

(57) ABSTRACT

The present invention provides: an electrophotographic photosensitive member which can achieve both of abrasion resistance and electrical characteristics; a production method of the electrophotographic photosensitive member; and a process cartridge and an electrophotographic apparatus having the electrophotographic photosensitive member. A surface layer of the electrophotographic photosensitive member includes a cured product and a specific amount of an alcohol or carboxylic acid having a specific structure, wherein the cured product is a polymerized product of a hole transporting compound having an acryloyloxy group or a methacryloyloxy group.

12 Claims, 1 Drawing Sheet

(56) References Cited

U.S. PATENT DOCUMENTS

| | | | |
|---|---|---|---|
| 7,813,675 | B2 | 10/2010 | Tanabe et al. |
| 7,910,274 | B2 | 3/2011 | Tanaka et al. |
| 8,088,541 | B2 | 1/2012 | Tanaka et al. |
| 8,415,078 | B2 | 4/2013 | Tanaka et al. |
| 8,783,209 | B2 | 7/2014 | Kaku et al. |
| 9,244,369 | B2 | 1/2016 | Tanaka et al. |
| 9,389,521 | B2 | 7/2016 | Takahashi et al. |
| 9,594,318 | B2 | 3/2017 | Nakata et al. |
| 9,772,596 | B2 | 9/2017 | Mitsui et al. |
| 9,811,012 | B2 | 11/2017 | Murakami et al. |
| 9,983,490 | B2 | 5/2018 | Shimada et al. |
| 10,042,272 | B2 | 8/2018 | Mori et al. |
| 2014/0004450 | A1 | 1/2014 | Tokimitsu et al. |
| 2014/0093281 | A1 | 4/2014 | Takahashi et al. |
| 2017/0364025 | A1 | 12/2017 | Nakata et al. |

OTHER PUBLICATIONS

U.S. Appl. No. 15/980,806, Koichi Nakata, filed May 16, 2018.
U.S. Appl. No. 16/002,421, Koichi Nakata, filed Jun. 7, 2018.
U.S. Appl. No. 16/101,575, Koichi Nakata, filed Aug. 13, 2018.

ELECTROPHOTOGRAPHIC PHOTOSENSITIVE MEMBER, PRODUCTION METHOD OF ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, a production method thereof, and a process cartridge and an electrophotographic apparatus having the electrophotographic photosensitive member.

Description of the Related Art

An electrophotographic photosensitive member to be mounted to an electrophotographic apparatus includes an organic electrophotographic photosensitive member (hereinafter, referred to as "electrophotographic photosensitive member") containing an organic photo-conductive material (charge generation material), and such an electrophotographic photosensitive member has been heretofore widely studied. In recent years, for the purpose of extending the life and enhancing an image quality of the electrophotographic photosensitive member, the electrophotographic photosensitive member is required to have mechanical durability (abrasion resistance) and show less fluctuation in electrical characteristics occurring due to long-term service.

Japanese Patent Application Laid-Open No. 2000-066425 describes a method for improving the mechanical durability of the electrophotographic photosensitive member and stabilizing the electrical characteristics, by imparting a polymerized product obtained by polymerizing a charge transporting substance which has a polymerizable functional group on the outermost surface layer of the electrophotographic photosensitive member.

In Japanese Patent Application Laid-Open No. 2016-090593, a hole transporting compound having an acryloyloxy group or a methacryloyloxy group and a cured product of a composition that contains a monomer containing a specific long-chain alkyl group are contained in the surface layer of the electrophotographic photosensitive member. It is described that the electrophotographic photosensitive member thereby shows high scratch resistance and high durability, and suppresses image defects caused by its insufficient lubricity and potential variation.

SUMMARY OF THE INVENTION

However, in the electrophotographic photosensitive members described in Japanese Patent Application Laid-Open No. 2000-066425 and Japanese Patent Application Laid-Open No. 2016-090593, mechanical durability is imparted and variation in electrical characteristics is reduced, but when the number of output sheets per unit time has increased, the variation of the electrical characteristics in short-term continuous service is insufficiently suppressed.

An object of the present invention is to provide an electrophotographic photosensitive member which can achieve both of the abrasion resistance and the electrical characteristics in an electrophotographic photosensitive member having a support and a photosensitive layer formed on the support, and to provide a production method thereof. In addition, another object of the present invention is to provide a process cartridge and an electrophotographic apparatus having the above described electrophotographic photosensitive member.

The above described object is achieved by the following present invention. Specifically, the electrophotographic photosensitive member according to the present invention is an electrophotographic photosensitive member having a support, a charge generation layer, a charge transport layer and a surface layer in the listed order, wherein the surface layer contains a cured product and a compound represented by the following formula (1) or (2), wherein the cured product is a polymerized product of a hole transporting compound having an acryloyloxy group or a methacryloyloxy group, and the compound represented by the following formula (1) or (2) is contained in an amount of 50 to 4000 ppm with respect to the hole transporting compound having an acryloyloxy group or a methacryloyloxy group.

$$H_3C—(CH_2)_a—COOH \quad (1)$$

$$H_3C—(CH_2)_b—OH \quad (2)$$

In the formula (1), a is an integer of 6 or more. In the formula (2), b is an integer of 6 or more.

In addition, the present invention is to provide a production method of the electrophotographic photosensitive member, the production method including: preparing a coating liquid for a surface layer, which contains a hole transporting compound having an acryloyloxy group or a methacryloyloxy group and a compound represented by the formula (1) or (2) in an amount of 50 to 4000 ppm based on the total solid content in the coating liquid; forming a coating film of the coating liquid for the surface layer; and curing the coating film to thereby form the surface layer of the electrophotographic photosensitive member.

In addition, the present invention is to provide a process cartridge which integrally supports the above described electrophotographic photosensitive member, and at least one unit selected from the group consisting of a charging unit, a developing unit, a transfer unit and a cleaning unit, and which is detachably attachable to a main body of an electrophotographic apparatus.

In addition, the present invention is to provide an electrophotographic apparatus having the above described electrophotographic photosensitive member, the charging unit, the exposure unit, the developing unit and the transfer unit.

The present invention can provide an electrophotographic photosensitive member which can achieve both of abrasion resistance and electrical characteristics in an electrophotographic photosensitive member having a support, a charge generation layer, a charge transport layer and a surface layer in the listed order, and provide a production method thereof. In addition, the present invention can provide a process cartridge and an electrophotographic apparatus having the above described electrophotographic photosensitive member.

Further features of the present invention will become apparent from the following description of exemplary embodiments with reference to the attached drawings.

DESCRIPTION OF THE EMBODIMENTS

Figure 1:
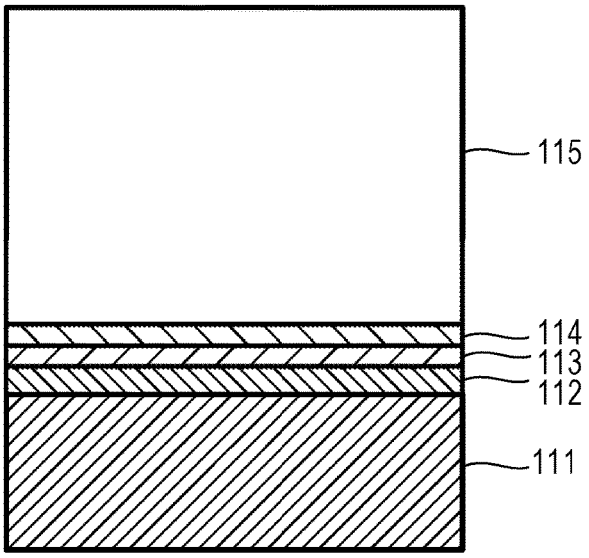
FIG. 1 is a view illustrating one layer configuration example of an electrophotographic photosensitive member of the present invention.

Preferred embodiments of the present invention will now be described in detail in accordance with the accompanying drawings.

Hereinafter, the present invention is described in detail with reference to preferable embodiments.

As described above, the present invention provides an electrophotographic photosensitive member having a support, a charge generation layer, a charge transport layer and a surface layer in the listed order, wherein the surface layer contains a cured product and a compound represented by the formula (1) or (2), wherein the cured product is a polymerized product of a hole transporting compound having an acryloyloxy group or a methacryloyloxy group, and the compound represented by the formula (1) or (2) is contained in an amount of 50 to 4000 ppm with respect to the hole transporting compound having an acryloyloxy group or a methacryloyloxy group.

The present inventors assume the reason why the electrophotographic photosensitive member having a specific configuration according to the present invention shows adequate electrical characteristics without any loss of abrasion resistance, in the following way.

The hole transporting compound has a hole transporting moiety having a low polarity, and an acryloyloxy group or methacryloyloxy group having a relatively high polarity. On the other hand, the compound represented by the above described formula (1) or (2) has an alkyl moiety having the low polarity and a polar moiety having the high polarity. Therefore, the hole transporting compound and the compound represented by the above described formula (1) or (2) are excellent in compatibility. Furthermore, the compound represented by the above described formula (1) or (2) does not have the acryloyloxy group or the methacryloyloxy group, and accordingly does not form the cured product by being polymerized with the hole transporting compound. Therefore, it is considered that fluidity is imparted to the film of the surface layer by the compound represented by the above described formula (1) or (2), which accordingly suppresses an increase in local ionization potential that originates in a twist of the hole transporting moiety in the cured film. In addition, if the above described compound represented by the formula (1) or (2) exists in an amount of more than 4000 ppm with respect to the hole transporting compound, a ratio of the cured product formed of the polymerized product of the hole transporting compound having an acryloyloxy group or a methacryloyloxy group, which exists in the surface layer, relatively decreases. Accordingly, a strength of the film of the surface layer is weakened, and the abrasion resistance is impaired. On the other hand, if the above described compound represented by the formula (1) or (2) is less than 50 ppm with respect to the hole transporting compound having an acryloyloxy group or a methacryloyloxy group, the fluidity is not imparted to the film of the surface layer, and adequate electrical characteristics cannot be obtained. Therefore, it is considered that if the surface layer contains the above described compound represented by the above described formula (1) or (2) in an amount of 50 to 4000 ppm with respect to the hole transporting compound having an acryloyloxy group or a methacryloyloxy group, the surface layer can obtain adequate electrical characteristics without any loss of its abrasion resistance.

The hole transporting compound having an acryloyloxy group or a methacryloyloxy group and the above described compound represented by the formula (1) or (2) which are used in the present invention may be used each singly or in combination of two or more.

Specific examples of the compound represented by the above described formulae (1) and (2) of the present invention include the following, but the present invention is not intended to be limited thereto.

| | | | |
|---|---|---|---|
| $H_3C—(CH_2)_6—COOH$ | (1-1) | $H_3C—(CH_2)_7—COOH$ | (1-2) |
| $H_3C—(CH_2)_8—COOH$ | (1-3) | $H_3C—(CH_2)_9—COOH$ | (1-4) |
| $H_3C—(CH_2)_{10}—COOH$ | (1-5) | $H_3C—(CH_2)_{11}—COOH$ | (1-6) |
| $H_3C—(CH_2)_{12}—COOH$ | (1-7) | $H_3C—(CH_2)_{13}—COOH$ | (1-8) |
| $H_3C—(CH_2)_{14}—COOH$ | (1-9) | $H_3C—(CH_2)_{15}—COOH$ | (1-10) |
| $H_3C—(CH_2)_{16}—COOH$ | (1-11) | $H_3C—(CH_2)_{17}—COOH$ | (1-12) |
| $H_3C—(CH_2)_{18}—COOH$ | (1-13) | $H_3C—(CH_2)_{19}—COOH$ | (1-14) |
| $H_3C—(CH_2)_{20}—COOH$ | (1-15) | $H_3C—(CH_2)_{21}—COOH$ | (1-16) |
| $H_3C—(CH_2)_{22}—COOH$ | (1-17) | $H_3C—(CH_2)_{23}—COOH$ | (1-18) |
| $H_3C—(CH_2)_6—OH$ | (2-1) | $H_3C—(CH_2)_7—OH$ | (2-2) |
| $H_3C—(CH_2)_8—OH$ | (2-3) | $H_3C—(CH_2)_9—OH$ | (2-4) |
| $H_3C—(CH_2)_{10}—OH$ | (2-5) | $H_3C—(CH_2)_{11}—OH$ | (2-6) |
| $H_3C—(CH_2)_{12}—OH$ | (2-7) | $H_3C—(CH_2)_{13}—OH$ | (2-8) |
| $H_3C—(CH_2)_{14}—OH$ | (2-9) | $H_3C—(CH_2)_{15}—OH$ | (2-10) |
| $H_3C—(CH_2)_{16}—OH$ | (2-11) | $H_3C—(CH_2)_{17}—OH$ | (2-12) |
| $H_3C—(CH_2)_{18}—OH$ | (2-13) | $H_3C—(CH_2)_{19}—OH$ | (2-14) |
| $H_3C—(CH_2)_{20}—OH$ | (2-15) | $H_3C—(CH_2)_{21}—OH$ | (2-16) |
| $H_3C—(CH_2)_{22}—OH$ | (2-17) | $H_3C—(CH_2)_{23}—OH$ | (2-18) |

In the above described formula (2), b is preferably an integer of 12 or more.

The hole transporting compound having an acryloyloxy group or a methacryloyloxy group of the present invention is preferably a compound represented by the following formula (a).

$$(P^1)_n—Z \quad \text{(a)}$$

In the above described formula (a), $P^1$ is a monovalent group represented by the following formula (b) or a monovalent group represented by the following formula (c); and n is an integer from 1 or more and 4 or less. When n is 2 or more, n pieces of $P^1$ may be the same or different. Z is a hole transporting group. A hydrogenated product in which a bonding moiety of Z and $P^1$ in the above described formula (a) is replaced with a hydrogen atom is a compound represented by the following formula (d) or a compound represented by the following formula (e).

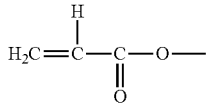
(b)

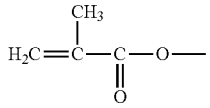
(c)

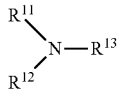
(d)

In the above described formula (d), $R^{11}$ to $R^{13}$ each independently represents a phenyl group, or a phenyl group which has an alkyl group having 1 to 6 carbon atoms as a substituent.

(e)

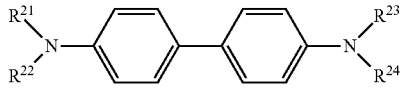

In the above described formula (e), $R^{21}$ to $R^{24}$ each independently represents a phenyl group, or a phenyl group which has an alkyl group having 1 to 6 carbon atoms as a substituent.

Specific examples (exemplary compounds) of a hole transporting compound having an acryloyloxy group or a methacryloyloxy group are shown below.

(a-1)

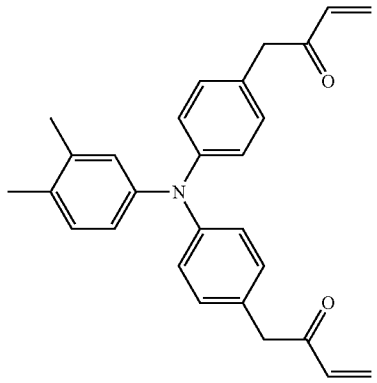

(a-2)

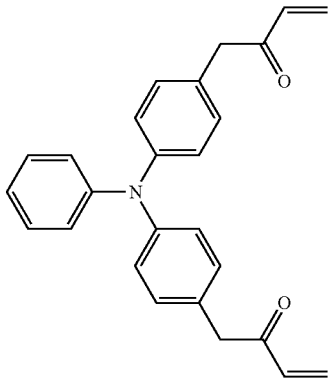

(a-3)

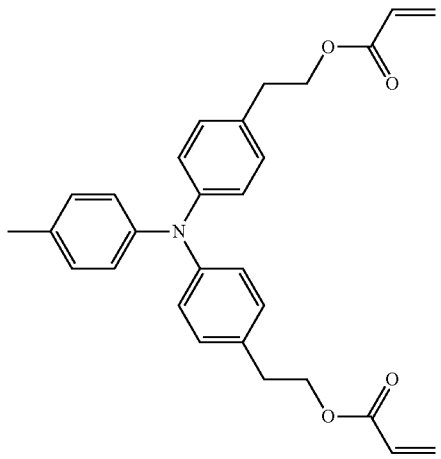

(a-4)

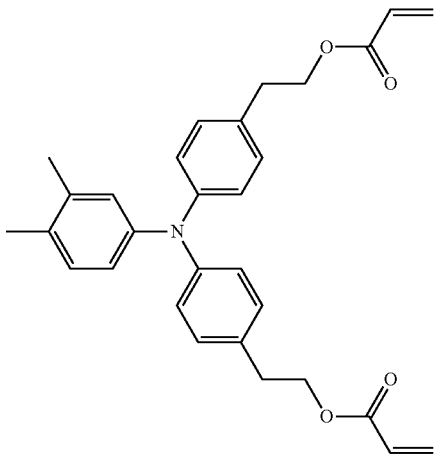

-continued
(a-5)
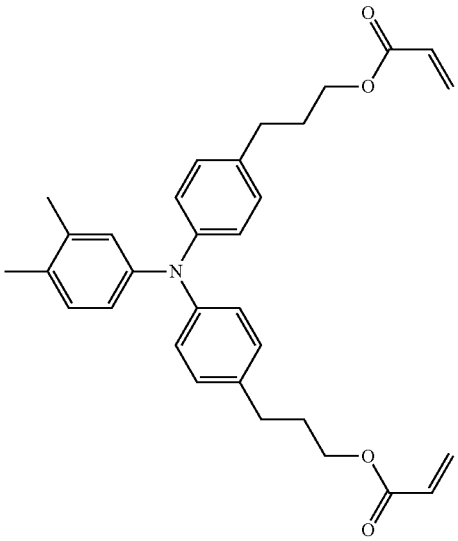
(a-6)
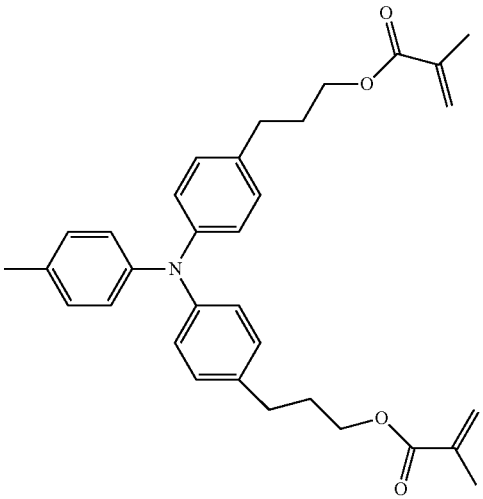
(a-7)
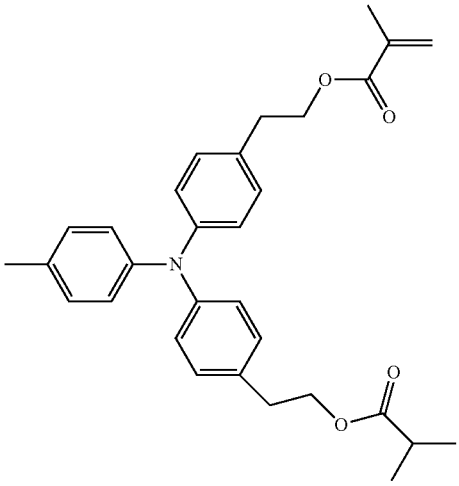
(a-8)
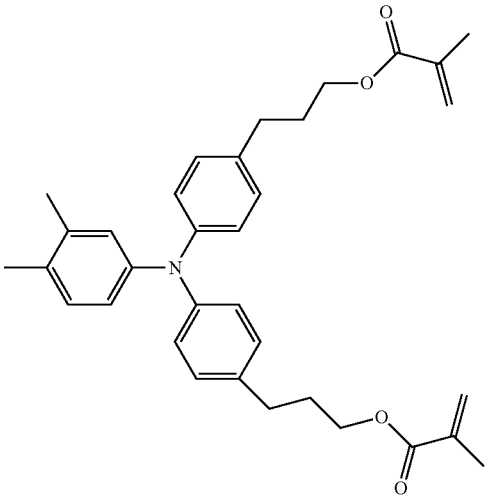
(a-9)
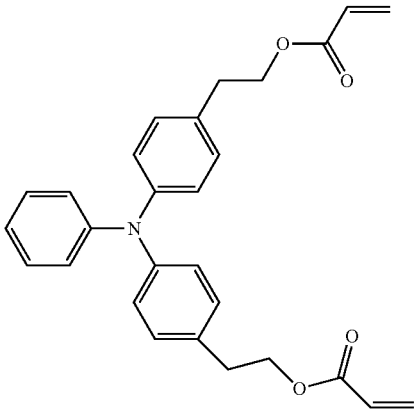
(a-10)
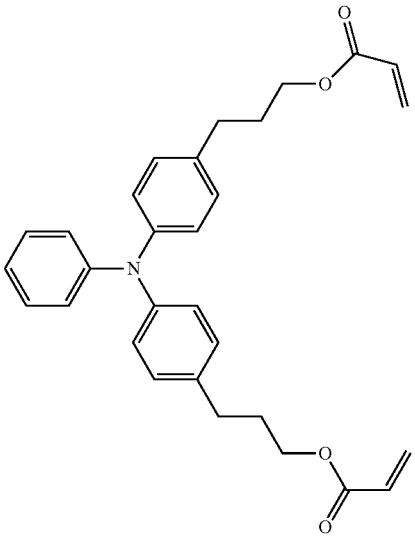

-continued
(a-11)
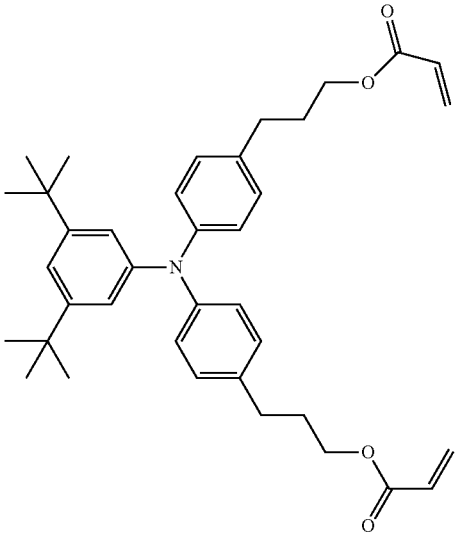
(a-12)
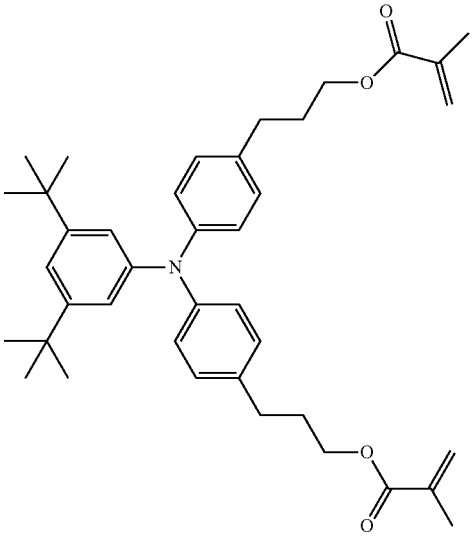
(a-13)
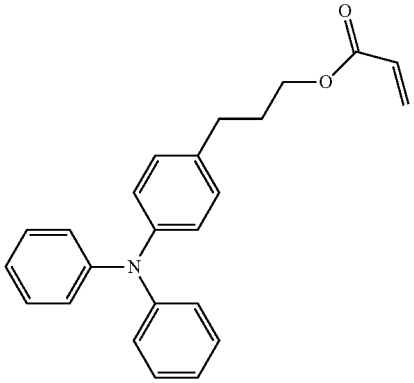
(a-14)
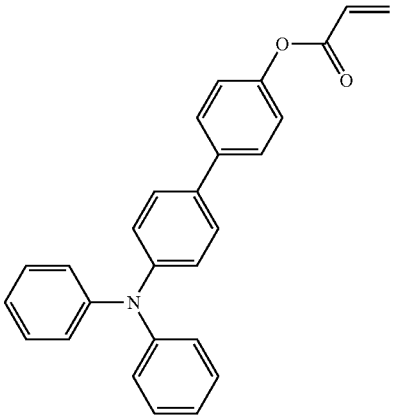
(a-15)
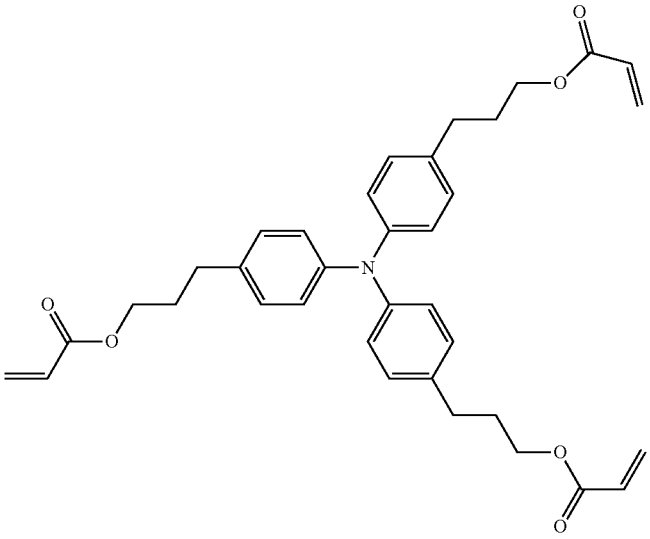

-continued (a-16)

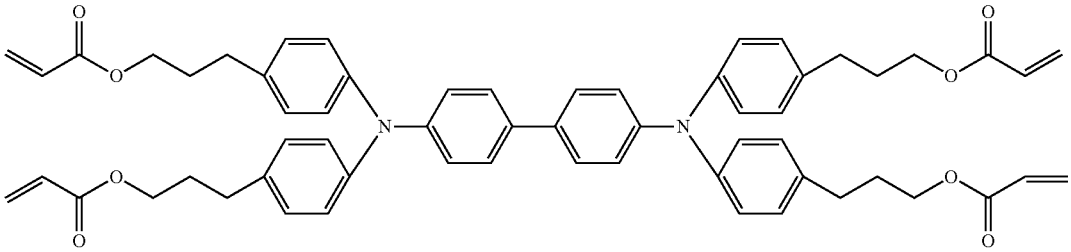

(a-17)

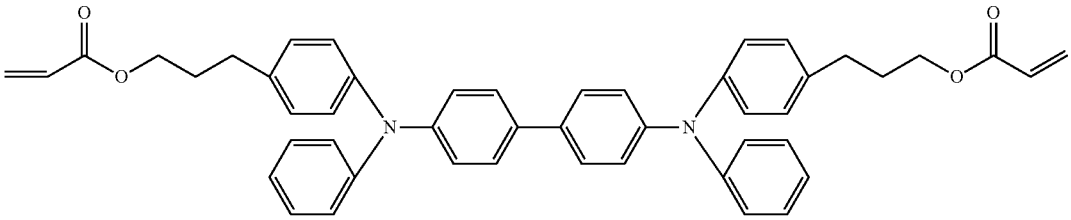

(a-18)

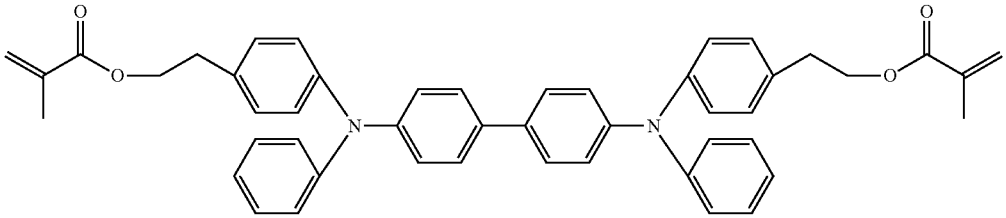

The cured product contained in the surface layer of the electrophotographic photosensitive member is preferably a copolymerized product with a compound which is represented by the following formula (3) or the following formula (4). By being a copolymer with the compounds, the cured product can further impart the fluidity to the film and makes the electrical characteristics adequate.

(3)

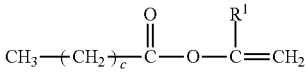

In the formula (3), $R^1$ is a hydrogen atom or a methyl group; and c is an integer of 6 or more.

(4)

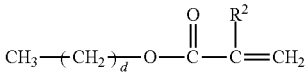

In the formula (4), $R^2$ is a hydrogen atom or a methyl group: and d is an integer of 6 or more.

Specific examples of the compound represented by the above described formulae (3) and (4) of the present invention include the following, but the present invention is not intended to be limited thereto.

(3-1)

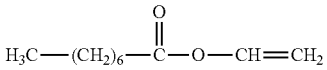

-continued (3-2)

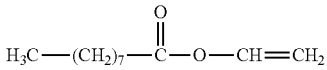

(3-3)

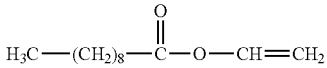

(3-4)

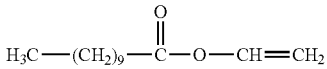

(3-5)

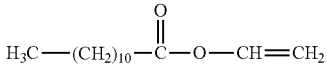

(3-6)

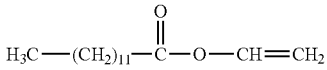

(3-7)

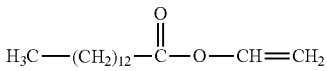

(3-8)

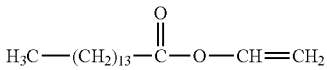

(3-9)

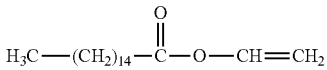

(3-10)

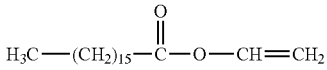

-continued (3-11)

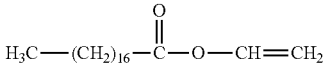

(3-12)

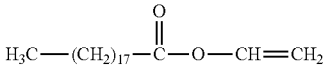

(3-13)

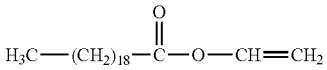

(3-14)

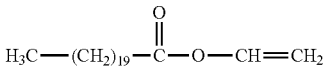

(3-15)

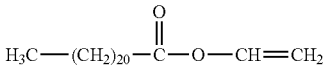

(3-16)

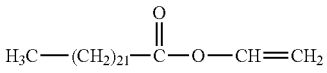

(3-17)

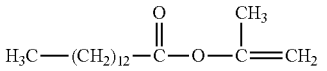

(3-18)

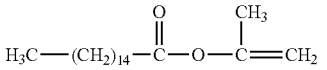

(4-1)

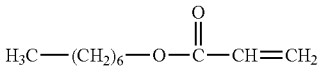

(4-2)

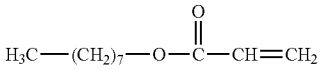

(4-3)

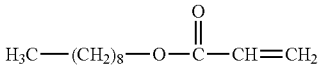

(4-4)

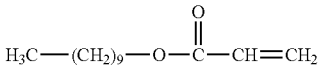

(4-5)

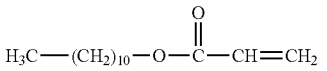

(4-6)

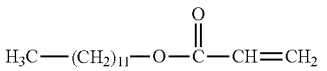

(4-7)

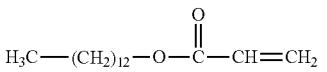

(4-8)

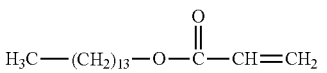

(4-9)

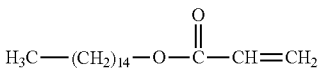

(4-10)

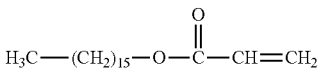

(4-11)

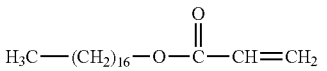

-continued (4-12)

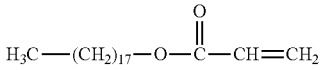

(4-13)

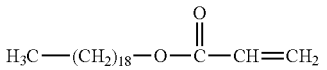

(4-14)

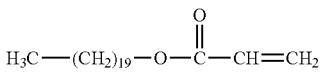

(4-15)

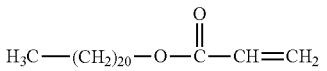

(4-16)

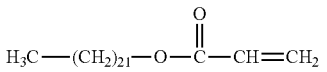

(4-17)

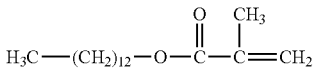

(4-18)

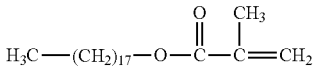

Furthermore, when the surface layer of the electrophotographic photosensitive member contains a cured product and the compound represented by the above described formula (2), and the cured product is a copolymerized product of a hole transporting compound having an acryloyloxy group or a methacryloyloxy group and the compound represented by the above described formula (4), it is preferable that the copolymerized product be a copolymerized product of: the hole transporting compound having an acryloyloxy group or a methacryloyloxy group; the compound represented by the above described formula (4); and a compound represented by the following formula (5) or the following formula (6). By being the copolymerized product with the compound represented by the following formula (5) or the following formula (6), the cured product can improve the abrasion resistance.

(5)

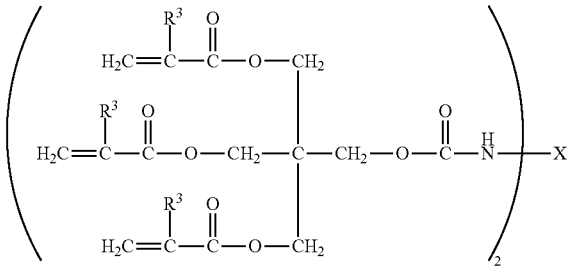

(6)

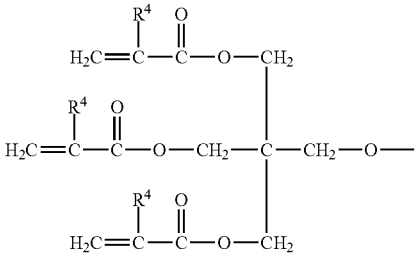

-continued

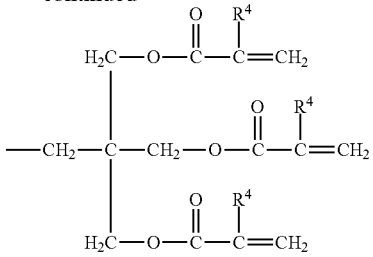

In the formula (5), $R^3$ is a hydrogen atom or a methyl group; and X is an alkylene group having 13 or less carbon atoms. In the formula (6), $R^4$ is a hydrogen atom or a methyl group.

In particular, it is preferable that X in the formula (5) be an alkylene group represented by the following formula (7).

(7)

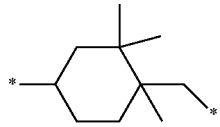

In the formula (7), * represents a linking group.

Specific examples of the compound represented by the above described formula (5) of the present invention include the following, but the present invention is not intended to be limited thereto.

(5-1)

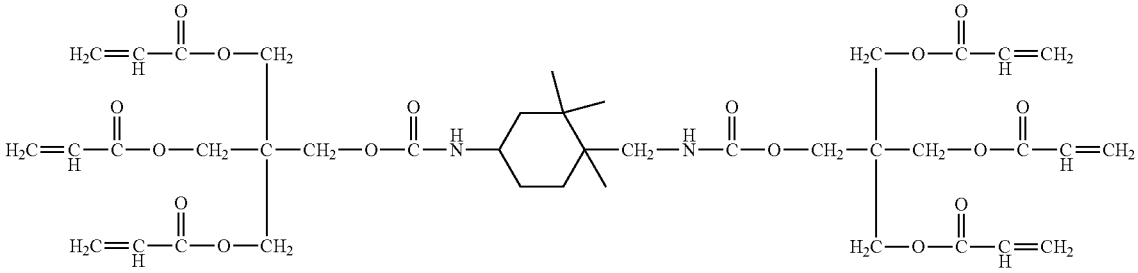

(5-2)

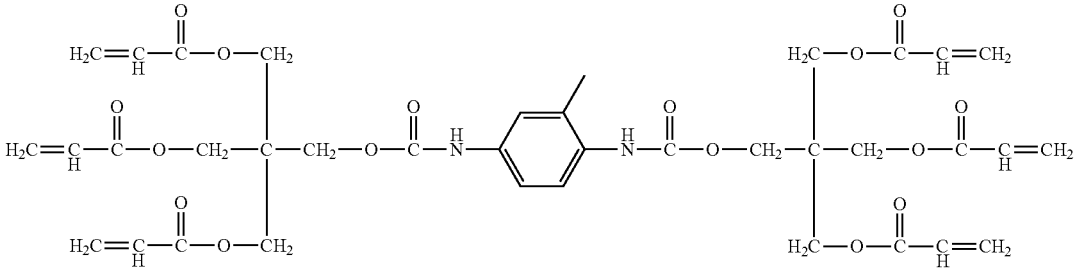

(5-3)

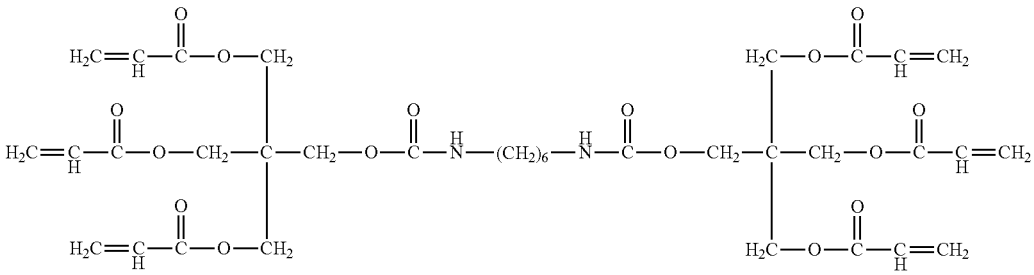

In addition, when the surface layer of the electrophotographic photosensitive member contains a cured product and the compound represented by the above described formula (2), and the cured product is a copolymerized product of the hole transporting compound having an acryloyloxy group or a methacryloyloxy group, and the compound represented by the above described formula (4), it is preferable that the hole transporting compound having an acryloyloxy group or a methacryloyloxy group be a compound represented by the following formula (8). The following formula (8) has extremely adequate compatibility with the compound represented by the above described formula (2), and accordingly can improve the electrical characteristics.

(8)

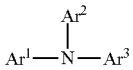

In the formula (8), $Ar^1$ represents a phenyl group substituted with a hydroxyl group or a hydroxyalkyl group. $Ar^2$ is a phenyl group substituted with an acryloyloxy group or a methacryloyloxy group. $Ar^3$ is a phenyl group which is unsubstituted or is substituted with an alkyl group.

In particular, it is preferable that the hole transporting compound represented by the above described formula (8) be a hole transporting compound represented by the following formula (9).

(9)

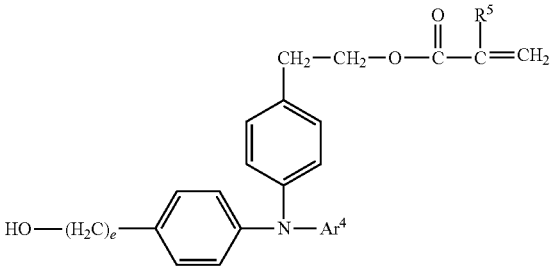

In the formula (9), $R^5$ is a hydrogen atom or a methyl group. $Ar^4$ is a phenyl group or a tolyl group; and e is an integer of 1 or more.

Specific examples of the compound represented by the above described formula (9) of the present invention include the following, but the present invention is not intended to be limited thereto.

(9-1)

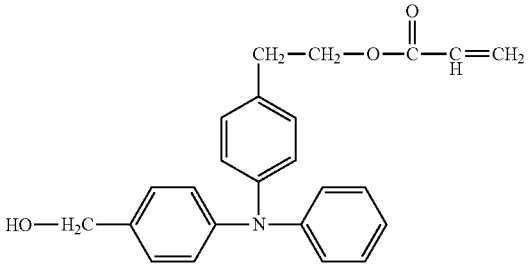

-continued (9-2)

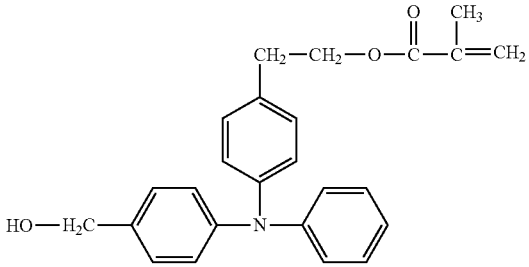

(9-3)

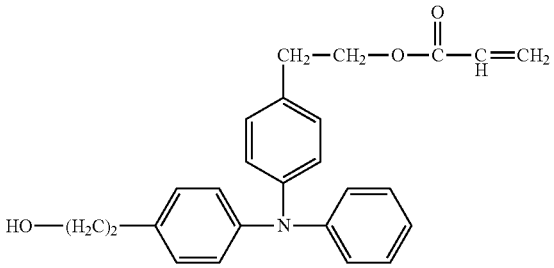

(9-4)

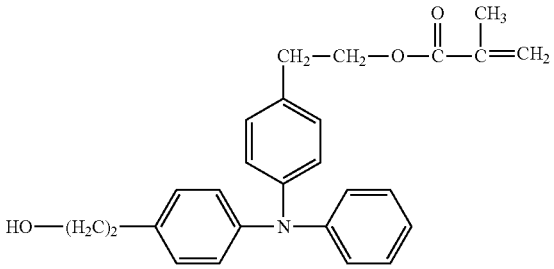

(9-5)

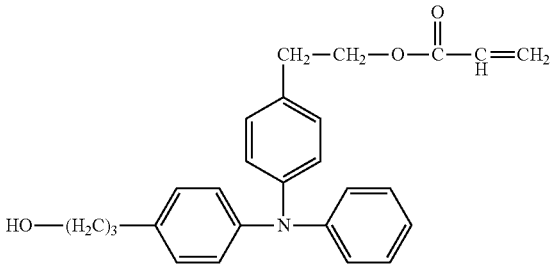

(9-6)

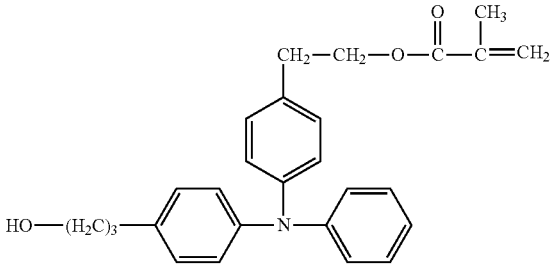

-continued (9-7)

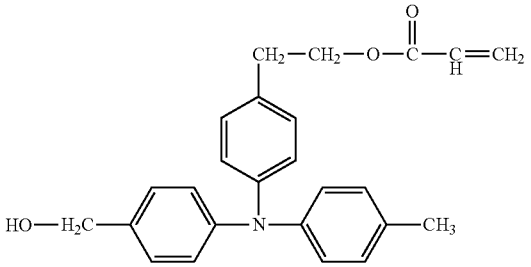

(9-8)

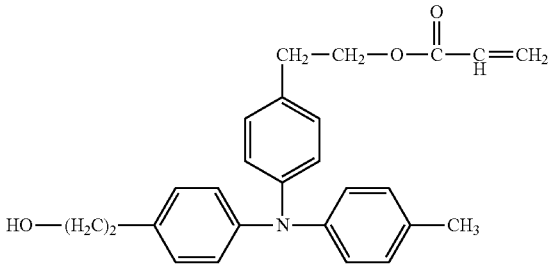

(9-9)

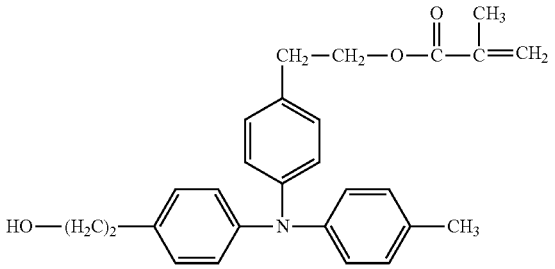

(9-10)

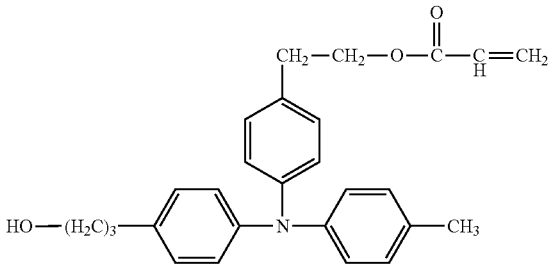

A production method of an electrophotographic photosensitive member of the present invention, which has a support, a charge generation layer, a charge transport layer and a surface layer in the listed order, includes: preparing a coating liquid for a surface layer, which contains a hole transporting compound having an acryloyloxy group or a methacryloyloxy group and a compound represented by the formula (1) or (2) in an amount of 50 to 4000 ppm based on the total solid content in the coating liquid; forming a coating film of the coating liquid for the surface layer; and curing the coating film to thereby form the surface layer of the electrophotographic photosensitive member.

Examples of a unit for curing the coating film of the coating liquid for the surface layer includes a method of curing the coating film by heat, ultraviolet light and/or an electron beam. In order to improve the strength of the surface layer of the electrophotographic photosensitive member and the durability of the electrophotographic photosensitive member, it is preferable to cure the coating film by use of ultraviolet light or an electron beam.

When the coating film is irradiated with the electron beam, examples of an accelerator include scanning type, electrocurtain type, broad beam type, pulse type and laminar type accelerators. The acceleration voltage of the electron beam is preferably 120 kV or less, from the viewpoint that degradation of the material characteristics due to the electron beam can be suppressed without any loss of polymerization efficiency. In addition, the dose of the electron beam absorbed on the surface of the coating film of the coating liquid for the surface layer is preferably 1 kGy or more and 50 kGy or less, and is more preferably 5 kGy or more and 10 kGy or less.

In addition, when the above described composition is cured (polymerized) by use of the electron beam, it is preferable to irradiate the composition with the electron beam under an inert gas atmosphere, and then heat the composition under an inert gas atmosphere, from the viewpoint of suppressing a polymerization inhibition action by oxygen. Examples of the inert gas include nitrogen, argon and helium.

In addition, it is preferable to irradiate the composition with ultraviolet light or the electron beam, and then heat the electrophotographic photosensitive member to 100° C. or higher and 140° C. or lower. Thereby, a surface layer is obtained which has further high durability and suppresses image defects.

Next, a configuration of the electrophotographic photosensitive member to be used in the present invention is described.

[Electrophotographic Photosensitive Member]

The electrophotographic photosensitive member of the present invention includes: a support, a charge generation layer formed on the support, a charge transport layer formed on the charge generation layer, and a surface layer formed on the charge transport layer.

FIG. 1 is a view illustrating one layer configuration example of an electrophotographic photosensitive member.

In FIG. 1, the electrophotographic photosensitive member has a support 111, an undercoat layer 112, a charge generation layer 113, a charge transport layer 114 and a surface layer 115.

In addition, as described above, the surface layer of the electrophotographic photosensitive member contains a cured product and a compound represented by the following formula (1) or (2), and the cured product is a polymerized product of a hole transporting compound having an acryloyloxy group or a methacryloyloxy group.

Examples of a method for producing the electrophotographic photosensitive member of the present invention include a method of preparing a coating liquid for each layer which will be described later, coating a desired layer in order, and drying the layers. At this time, examples of the method for coating the coating liquid include dip-coating, spray coating, inkjet coating, roll coating, die coating, blade coating, curtain coating, wire bar coating and ring coating. Among these methods, the dip-coating is preferable from the viewpoint of efficiency and productivity.

Hereinafter, the support and each layer are described.

<Support>

In the present invention, the electrophotographic photosensitive member has the support. In the present invention, the support is preferably an electro-conductive support having electro-conductivity. In addition, examples of the shape of the support include a cylindrical shape, a belt shape and a sheet shape. Among the shapes, a cylinder-shaped support is preferable. In addition, the surface of the support may be subjected to electrochemical treatment such as anodic oxidation, blast treatment and cutting treatment.

Materials of the support are preferably a metal, a resin, glass and the like.

Examples of the metal include aluminum, iron, nickel, copper, gold, stainless steel and alloys thereof. Among the metals, an aluminum support using aluminum is preferable.

In addition, electro-conductivity may be imparted to the resin or the glass by treatment such as mixing of or covering with the electro-conductive material.

<Electro-Conductive Layer>

In the present invention, an electro-conductive layer may also be provided on the support. By being provided, the electro-conductive layer can shield scarring and/or irregularities on the support surface and control reflection of light on the support surface.

It is preferable that the electro-conductive layer contain an electro-conductive particle and a resin.

Examples of the material of the electro-conductive particle include a metal oxide, metal, and carbon black.

Examples of the metal oxide include zinc oxide, aluminum oxide, indium oxide, silicon oxide, zirconium oxide, tin oxide, titanium oxide, magnesium oxide, antimony oxide and bismuth oxide. Examples of the metal include aluminum, nickel, iron, nichrome, copper, zinc and silver.

Among the materials, the metal oxide is preferably used, and titanium oxide, tin oxide or zinc oxide is particularly preferably used, as the electro-conductive particle.

When the metal oxide is used as the electro-conductive particle, the surface of the metal oxide may be treated with a silane coupling agent or the like, and the metal oxide may be doped with an element such as phosphorus or aluminum or an oxide thereof.

In addition, the electro-conductive particle may have a stacked structure having a core particle and a covering layer which covers the particle. Examples of the core particle include titanium oxide, barium sulfate and zinc oxide. Examples of the covering layer include metal oxide such as tin oxide.

In addition, when the metal oxide is used as the electro-conductive particle, the volume average particle size thereof is preferably 1 nm or more and 500 nm or less, and is more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin and an alkyd resin.

In addition, the electro-conductive layer may further contain a masking agent such as silicone oil, a resin particle, and titanium oxide.

The average film thickness of the electro-conductive layer is preferably 1 μm or more and 50 μm or less, and is particularly preferably 3 μm or more and 40 μm or less.

The electro-conductive layer can be formed by operations of: preparing a coating liquid for an electro-conductive layer, which contains each of the above described materials and a solvent; forming the coating film of the coating liquid; and drying the coating film. Examples of the solvent to be used in the coating liquid include an alcohol-based solvent, a sulfoxide-based solvent, a ketone-based solvent, an ether-based solvent, an ester-based solvent and an aromatic hydrocarbon-based solvent. Examples of a dispersing method for dispersing the electro-conductive particles in the coating liquid for the electro-conductive layer include a method using a paint shaker, a sand mill, a ball mill, or a liquid collision type high-speed disperser.

<Undercoat Layer>

In the present invention, an undercoat layer may be provided on the support or the electro-conductive layer. By being provided, the undercoat layer can enhance the adhesion function between layers and impart the charge injection inhibition function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide-imide resin, and a cellulose resin.

Examples of the polymerizable functional group in the monomer having the polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group and a carbon-carbon double bond group.

In addition, the undercoat layer may further contain an electron transport material, a metal oxide, a metal, an electro-conductive polymer and the like, for the purpose of enhancing the electrical characteristics. Among the above materials, it is preferable to use the electron transport material and/or the metal oxide.

Examples of the electron transport material include a quinone compound, an imide compound, a benzimidazole compound, a cyclopentadienylidene compound, a fluorenone compound, a xanthone compound, a benzophenone compound, a cyanovinyl compound, an aryl halide compound, a silole compound and a boron-containing compound. The undercoat layer may be formed as the cured film by using the electron transport material having an polymerizable functional group, as the electron transport material, and copolymerizing the electron transport material with the above described monomer having the polymerizable functional group.

Examples of the metal oxide include indium tin oxide, tin oxide, indium oxide, titanium oxide, zinc oxide, aluminum oxide and silicon dioxide. Examples of the metal include gold, silver and aluminum.

In addition, the undercoat layer may further contain an additive.

An average film thickness of the undercoat layer is preferably 0.1 μm or more and 50 μm or less, is more preferably 0.2 μm or more and 40 μm or less, and is particularly preferably 0.3 μm or more and 30 μm or less.

The undercoat layer can be formed by operations of: preparing a coating liquid for the undercoat layer, which contains each of the above described materials and a solvent; forming a coating film of the coating liquid on the support or the electro-conductive layer; and drying and/or curing the coating film. Examples of the solvent to be used in the coating liquid include an alcohol-based solvent, a ketone-based solvent, an ether-based solvent, an ester-based solvent and an aromatic hydrocarbon-based solvent.

<Charge Generation Layer>

The charge generation layer preferably contains a charge generation material and a resin.

Examples of the charge generation material include an azo pigment, a perylene pigment, a polycyclic quinone pigment, an indigo pigment and a phthalocyanine pigment. Among the pigments, the azo pigment and the phthalocyanine pigment are preferable. Among the phthalocyanine pigments, an oxytitanium phthalocyanine pigment, a chlorogallium phthalocyanine pigment and a hydroxygallium phthalocyanine pigment are preferable.

The content of the charge generation material in the charge generation layer is preferably 40 mass % or more and 85 mass % or less, and is more preferably 60 mass % or more and 80 mass % or less, based on the total mass of the charge generation layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. Among the resins, the polyvinyl butyral resin is more preferable.

In addition, the charge generation layer may further contain additives such as an antioxidant and an ultraviolet absorber. Specific examples thereof include a hindered phenol compound, a hindered amine compound, a sulfur compound, a phosphorus compound and a benzophenone compound.

An average film thickness of the charge generation layer is preferably 0.1 μm or more and 1 μm or less, and is more preferably 0.15 μm or more and 0.4 μm or less.

The charge generation layer can be formed by operations of: preparing a coating liquid for the charge generation layer, which contains each of the above described materials and a solvent; forming a coating film of the coating liquid on the undercoat layer; and drying the coating film. Examples of the solvent to be used in the coating liquid include an alcohol-based solvent, a sulfoxide-based solvent, a ketone-based solvent, an ether-based solvent, an ester-based solvent and an aromatic hydrocarbon-based solvent.

<Charge Transport Layer>

The charge transport layer preferably contains a charge transport material and a resin.

Examples of the charge transport material include a polycyclic aromatic compound, a heterocyclic compound, a hydrazone compound, a styryl compound, an enamine compound, a benzidine compound, a triarylamine compound, and resins having groups derived from the materials thereof.

The content of the charge transport material in the charge transport layer is preferably 25 mass % or more and 70 mass % or less, and is more preferably 30 mass % or more and 55 mass % or less, based on the total mass of the charge transport layer.

Examples of the resin include a polyester resin, a polycarbonate resin, an acrylic resin and a polystyrene resin. Among the resins, the polycarbonate resin and the polyester resin are preferable. In the polyester resins, a polyarylate resin is particularly preferable.

The content ratio (mass ratio) between the charge transport material and the resin is preferably 4:10 to 20:10, and is more preferably 5:10 to 12:10.

In addition, the charge transport layer may contain additives such as an antioxidant, an ultraviolet absorber, a plasticizer, a leveling agent, a lubricity imparting agent and an abrasion resistance improver. Specific examples thereof include a hindered phenol compound, a hindered amine compound, a sulfur compound, a phosphorus compound, a benzophenone compound, a siloxane modified resin, silicone oil, a fluororesin particle, a polystyrene resin particle, a polyethylene resin particle, a silica particle, an alumina particle and a boron nitride particle.

In particular, it is preferable to contain a compound represented by the following formula (10).

(10)

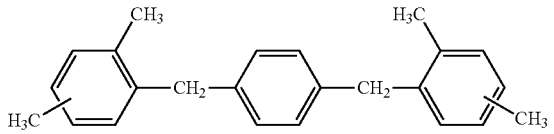

The compound of the above described formula (10) has a polymerization inhibition action, accordingly suppresses crosslinking properties in the vicinity of the interface between the charge transport layer and the surface layer, and lowers a difference in ionization potentials between the charge transport layer and the surface layer; and accordingly the electrical characteristics become adequate.

The average film thickness of the charge transport layer is preferably 5 μm or more and 50 μm or less, is more preferably 8 μm or more and 40 μm or less, and is particularly preferably 10 μm or more and 30 μm or less.

The charge transport layer can be formed by operations of: preparing a coating liquid for the charge transport layer, which contains each of the above described materials and a solvent: forming a coating film of the coating liquid on the charge generation layer; and drying the coating film. Examples of the solvent to be used in the coating liquid include an alcohol-based solvent, a ketone-based solvent, an ether-based solvent, an ester-based solvent and an aromatic hydrocarbon-based solvent. Among the above solvents, the ether-based solvent or the aromatic hydrocarbon-based solvent is preferable.

<Surface Layer>

In the present invention, the electrophotographic photosensitive member has a surface layer on the charge transport layer. By having the surface layer provided therein, the electrophotographic photosensitive member can improve its durability.

In addition, the surface layer may be formed as a cured film by polymerizing a composition containing a monomer having a polymerizable functional group. Examples of reactions at that time include a thermal polymerization reaction, a photopolymerization reaction and a radiation-induced polymerization reaction. Examples of the polymerizable functional group in the monomer having the polymerizable functional group include an acryloyloxy group and a methacryloyloxy group. A material having a charge transporting ability may be used as the monomer having the polymerizable functional group.

The surface layer may also contain additives such as an antioxidant, an ultraviolet absorber, a plasticizer, a leveling agent, a lubricity imparting agent and an abrasion resistance improver. Specific examples thereof include a hindered phenol compound, a hindered amine compound, a sulfur compound, a phosphorus compound, a benzophenone compound, a siloxane modified resin, silicone oil, a fluororesin particle, a polystyrene resin particle, a polyethylene resin particle, a silica particle, an alumina particle and a boron nitride particle.

Furthermore, the charge transport material can be added. Examples of the charge transport material include a triarylamine compound, a hydrazone compound, a stilbene compound, a pyrazoline compound, an oxazole compound, a thiazole compound and a triarylmethane compound.

An average film thickness of the surface layer is preferably 0.5 μm or more and 10 μm or less, and is more preferably 1 μm or more and 7 μm or less.

The surface layer can be formed by operations of: preparing a coating liquid for the surface layer, which contains each of the above described materials and a solvent; forming a coating film of the coating liquid on the charge transport layer; and drying and/or curing the coating film. Examples of the solvent to be used in the coating liquid include an alcohol-based solvent, a ketone-based solvent, an ether-based solvent, a sulfoxide-based solvent, an ester-based solvent, a halogenated aliphatic hydrocarbon-based solvent, and an aromatic hydrocarbon-based solvent. The alcohol-based solvent is preferable, from the viewpoint that the charge transport layer of the lower layer is not dissolved.

The surface of the surface layer may be subjected to surface processing with the use of an abrasive sheet, a shape transfer mold member, glass beads, zirconia beads or the like. In addition, irregularities may be formed on the surface with the use of a constituent material of the coating liquid. It is more preferable to provide recesses or projections on the surface layer of the electrophotographic photosensitive member, for the purpose of more stabilizing a behavior of a cleaning unit (cleaning blade) which is brought into contact with the electrophotographic photosensitive member.

The above described recesses or projections may be formed on the whole area of the surface of the electrophotographic photosensitive member, or may be formed on a part of the surface of the electrophotographic photosensitive member. In the case where the recesses or the projections are formed on a part of the surface of the electrophotographic photosensitive member, it is preferable that the recesses or the projections be formed at least on the whole area of the contact region with the cleaning unit (cleaning blade).

When the recesses or the projections are formed, the recesses or the projections can be formed on the surface of the electrophotographic photosensitive member, by operations of: bringing a mold having the projections corresponding to the recesses or the recesses corresponding to the projections, into pressure contact with the surface of the electrophotographic photosensitive member; and transferring the shapes to the surface.

[Process Cartridge, and Electrophotographic Apparatus]

The process cartridge of the present invention includes: integrally supporting the electrophotographic photosensitive member described above, and at least one unit selected from the group consisting of a charging unit, a developing unit, a transfer unit and a cleaning unit; and being detachably attachable to a main body of an electrophotographic apparatus.

In addition, the electrophotographic apparatus of the present invention includes the electrophotographic photosensitive member described above, a charging unit, an exposure unit, a developing unit and a transfer unit.

Figure 2:
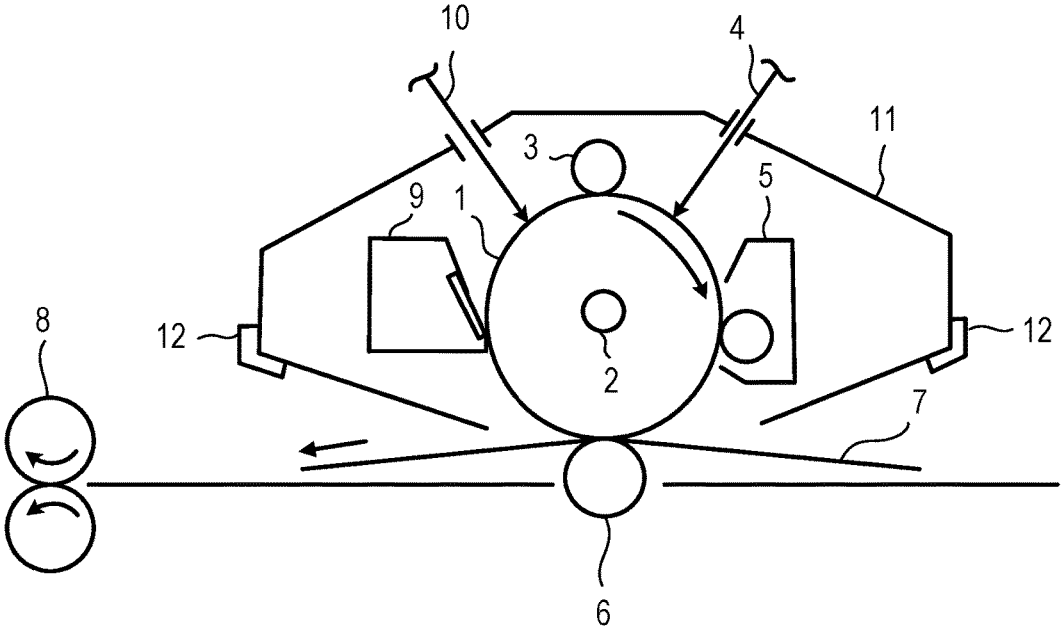
FIG. 2 is a view illustrating one schematic configuration example of an electrophotographic apparatus provided with a process cartridge including the electrophotographic photosensitive member of the present invention.

FIG. 2 illustrates one schematic configuration example of an electrophotographic apparatus having a process cartridge provided with an electrophotographic photosensitive member.

Reference Numeral 1 represents a cylinder-shaped electrophotographic photosensitive member, and the electrophotographic photosensitive member is rotary-driven around a shaft 2 in an arrow direction at a predetermined peripheral velocity. The surface of the electrophotographic photosensitive member 1 is positively or negatively charged to have a predetermined potential by a charging unit 3. Incidentally, a roller charging system by a roller type charging member is illustrated in the figure, but a charging system such as a corona charging system, a proximity charging system or an injection charging system may also be adopted. The surface of the charged electrophotographic photosensitive member 1 is irradiated with exposure light 4 emitted from an exposure unit (not illustrated), and an electrostatic latent image corresponding to objective image information is formed thereon. The electrostatic latent image formed on the surface of the electrophotographic photosensitive member 1 is developed by a toner stored in a developing unit 5, to form a toner image on the surface of the electrophotographic photosensitive member 1. The toner image formed on the surface of the electrophotographic photosensitive member 1 is transferred onto a transfer material 7 by a transfer unit 6. The transfer material 7 to which the toner image has been transferred is conveyed to a fixing unit 8, is subjected to fixing treatment of the toner image, and is printed out to the outside of the electrophotographic apparatus. The electrophotographic apparatus may have a cleaning unit 9 for removing an attached object such as a toner remaining on the surface of the electrophotographic photosensitive member 1 after transferring. Alternatively, a cleaning unit may not be separately provided, but a so-called cleanerless system may be used that removes the above described attached object by a developing unit or the like. The electrophotographic apparatus may have a neutralization mechanism that subjects the surface of the electrophotographic photosensitive member 1 to neutralization treatment by pre-exposure light 10 emitted from a pre-exposure unit (not illustrated). In addition, a guiding unit 12 such as a rail may also be provided in order to detachably attach the process cartridge 11 of the present invention to a main body of the electrophotographic apparatus.

The electrophotographic photosensitive member of the present invention can be used in a laser beam printer, an LED printer, a copier, a facsimile, a combined machine thereof and the like.

EXAMPLE

Hereinafter, the present invention is described in more detail with respect to Examples and Comparative Examples. The present invention is not intended to be limited to the following Examples at all without departing from the gist thereof. Herein, "part(s)" in the following Examples is on a mass basis unless particularly noted.

Example 1

An aluminum cylinder having a diameter of 30 mm, a length of 357.5 mm and a thickness of 1 mm was prepared as a support (electro-conductive support).

Next, a coating liquid for an undercoat layer was prepared, by mixing 6 parts of an alkyd resin (Beckosol 1307-60-EL, manufactured by DIC Corporation), 4 parts of a melamine resin (Super Beckamine G-821-60, manufactured by DIC Corporation), and 40 parts of a titanium oxide particle (CR-EL, manufactured by Ishihara Sangyo Kaisha, Ltd.), with 50 parts of methyl ethyl ketone.

The aluminum cylinder was dip-coated with the coating liquid for the undercoat layer to form a coating film, and the resultant coating film was heated and dried at 140° C. for 30 minutes to form the undercoat layer having a film thickness of 3.5 μm.

Next, a coating liquid for a charge generation layer was prepared, by mixing 2.5 parts of Y type titanyl phthalocyanine, and 0.5 parts of polyvinyl butyral resin (S-LEC BX-1, manufactured by Sekisui Chemical Co., Ltd.), with 280 parts of methyl ethyl ketone. The undercoat layer was dip-coated with the coating liquid for the charge generation layer to form a coating film, and the obtained coating film was heated and dried at 80° C. for 15 minutes to form the charge generation layer having a film thickness of 0.2 μm.

Next, a coating liquid for a charge transport layer was prepared, by mixing 10 parts of a bisphenol Z type polycarbonate (Panlite TS-2050, manufactured by Teijin Chemicals Ltd.), and 10 parts of a compound represented by the following formula (A), with 80 parts of Tetrahydrofuran and 0.1 parts of silicone oil (KF 50-100 CS, manufactured by Shin-Etsu Chemical Co., Ltd.). The charge generation layer was dip-coated with the coating liquid for the charge transport layer to form a coating film, and the obtained coating film was heated and dried at 110° C. for 60 minutes to form the charge transport layer having a film thickness of 22 μm.

(A)

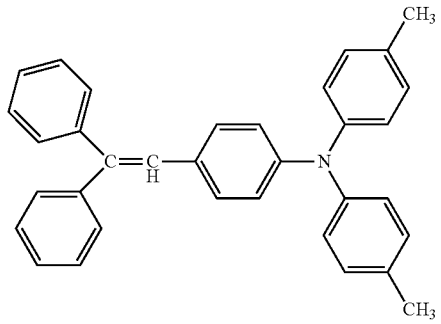

Thereafter, a coating liquid for a surface layer was prepared, by mixing 100.0 parts of the hole transporting compound represented by the formula (a-10), 0.400 parts of the compound represented by the formula (1-6), and 0.5 parts of methyl benzoyl formate which functions as a photopolymerization initiator, with 180 parts of isopropanol and 20 parts of tetrahydrofuran.

Next, the charge transport layer was dip-coated with the coating liquid for the surface layer to form a coating film, and the obtained coating film was dried at 60° C. for 5 minutes. After drying, the coating film was irradiated with ultraviolet light for 120 seconds at an irradiation intensity of 700 mW/cm$^2$, with the use of a metal halide lamp having an output of 160 W/cm. Thereafter, the coating film was subjected to heat treatment at 120° C. for 60 minutes to form the surface layer having a film thickness of 3.5 μm.

In this way, an electrophotographic photosensitive member was produced which had the undercoat layer, the charge generation layer, the charge transport layer and the surface layer in the listed order on the support.

Example 2

An electrophotographic photosensitive member was produced in the same way as in Example 1, except that the compound represented by the formula (1-6), which was used in Example 1, was changed to a compound represented by the formula (2-6) and a coating liquid for the surface layer was prepared.

Example 3

An electrophotographic photosensitive member was produced in the same way as in Example 1, except that the coating liquid for the surface layer, which was prepared in Example 1, was changed in the following way.

The coating liquid for the surface layer was prepared, by mixing 100.0 parts of the hole transporting compound represented by the formula (a-10), 0.250 parts of the compound represented by the formula (1-7), and 2.0 parts of the compound represented by the formula (3-7), with 180 parts of isopropanol and 20 parts of tetrahydrofuran.

Example 4

An electrophotographic photosensitive member was produced in the same way as in Example 3, except that the compounds represented by the formulae (1) and (3), which were used in Example 3, were changed to the compounds described in Table 1 and a coating liquid for the surface layer was prepared.

Example 5

An electrophotographic photosensitive member was produced in the same way as in Example 3, except that the compound represented by the formula (1-7) and the compound represented by the formula (3-7), which were used in Example 3, were changed to a compound represented by the formula (2-1) and a compound represented by the formula (4-1), respectively, and a coating liquid for the surface layer was prepared.

Example 6

An electrophotographic photosensitive member was produced in the same way as in Example 5, except that the charge transport layer which was formed in Example 5 was changed in the following way.

A coating liquid for the charge transport layer was prepared, by mixing 10 parts of bisphenol Z type polycarbonate (Panlite TS-2050, manufactured by Teijin Chemicals Ltd.), 10 parts of the compound represented by the above described formula (A), and 0.1 parts of a compound represented by the following formula (10-1), with 80 parts of tetrahydrofuran and 0.1 parts of silicone oil KF50-100CS (manufactured by Shin-Etsu Chemical Co., Ltd.). The charge generation layer was dip-coated with the coating liquid for the charge transport layer to form a coating film, and the obtained coating film was heated and dried at 110° C. for 60 minutes to form the charge transport layer having a film thickness of 22 μm.

(10-1)

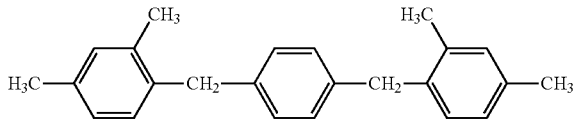

Example 7

An electrophotographic photosensitive member was produced in the same way as in Example 5, except that the compound represented by the formula (2-1) and the compound represented by the formula (4-1), which were used in Example 5, were changed to a compound represented by the formula (2-7) and a compound represented by the formula (4-7), respectively, and a coating liquid for the surface layer was prepared.

Example 8

An electrophotographic photosensitive member was produced in the same way as in Example 6, except that the surface layer which was formed in Example 6 was changed in the following way.

A coating liquid for the surface layer was prepared, by mixing 50.0 parts of a hole transporting compound represented by the formula (9-3), 0.125 parts of a compound represented by the formula (2-7), 2.0 parts of a compound represented by the formula (4-7), 50.0 parts of a compound represented by the formula (5-1), and 0.5 parts of methyl benzoyl formate which functions as a photopolymerization initiator, with 180 parts of isopropanol and 20 parts of tetrahydrofuran.

Next, the charge transport layer was dip-coated with the coating liquid for the surface layer to form a coating film, and the obtained coating film was dried at 60° C. for 5 minutes. After drying, the coating film was irradiated with ultraviolet light for 120 seconds at an irradiation intensity of 700 mW/cm$^2$, with the use of a metal halide lamp having an output of 160 W/cm. Thereafter, the coating film was subjected to heat treatment at 120° C. for 60 minutes to form the surface layer having a film thickness of 3.5 μm.

Examples 9 and 10

An electrophotographic photosensitive member was produced in the same way as in Example 8, except that the hole transporting compound and the compound represented by the formula (2), which were used in Example 8, were changed to the compounds described in Table 1 and the coating liquid for the surface layer was prepared.

Example 11

An electrophotographic photosensitive member was produced in the same way as in Example 8, except that the compound represented by the formula (5-1), which was used in Example 8, was changed to a compound represented by the formula (6-1) and a coating liquid for the surface layer was prepared.

(6-1)

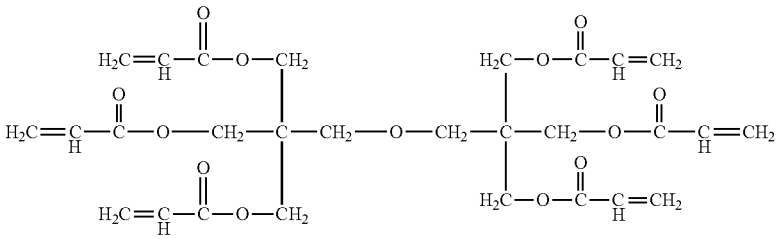

Example 12

An electrophotographic photosensitive member was produced in the same way as in Example 8, except that the coating liquid for the charge transport layer, which was prepared in Example 8, was changed in the following way.

A coating liquid for the charge transport layer was prepared, by mixing 10 parts of a bisphenol Z type polycarbonate (Panlite TS-2050, manufactured by Teijin Chemicals Ltd.), and 10 parts of the compound represented by the above described formula (A), with 80 parts of tetrahydrofuran and 0.1 parts of silicone oil KF50-100CS (manufactured by Shin-Etsu Chemical Co., Ltd.).

Examples 13 and 14

An electrophotographic photosensitive member was produced in the same way as in Example 11, except that the hole transporting compound which was used in Example 11 was changed to the compound shown in Table 1 and the coating liquid for the surface layer was prepared.

Example 15

An electrophotographic photosensitive member was produced in the same way as in Example 1, except that the surface layer which was formed in Example 1 was changed in the following way.

A coating liquid for the surface layer was prepared, by mixing 50.0 parts of a hole transporting compound represented by the formula (9-3), 0.125 parts of a compound represented by the formula (2-7), 2.0 parts of a compound represented by the formula (4-7), 50.0 parts of trimethylolpropane triacrylate (trade name: KAYARAD TMPTA, manufactured by Nippon Kayaku Co., Ltd.), and 1 part of a photopolymerization initiator Irgacure 184 (1-hydroxycyclohexyl phenyl ketone) (manufactured by Ciba Specialty Chemicals), with 500 parts of tetrahydrofuran.

Next, the charge transport layer was dip-coated with the coating liquid for the surface layer to form a coating film, and the coating film was irradiated with ultraviolet light for 120 seconds at an irradiation intensity of 700 mW/cm$^2$, with the use of a metal halide lamp having an output of 160 W/cm. Thereafter, the coating film was subjected to heat treatment at 130° C. for 20 minutes to form the surface layer having a thickness of 3.5 μm.

Examples 16 and 17

An electrophotographic photosensitive member was produced in the same way as in Example 15, except that the hole transporting compound, the compound represented by the formula (2) and the compound represented by the formula (4), which were used in Example 15, were changed to the compounds shown in Table 1 and the coating liquid for the surface layer was prepared.

Example 18

An electrophotographic photosensitive member was produced in the same way as in Example 14, except that the compound represented by the formula (2) and the compound represented by the formula (4), which were used in Example 14, were changed to the compounds shown in Table 1 and a coating liquid for the surface layer was prepared.

Example 19

An electrophotographic photosensitive member was produced in the same way as in Example 15, except that the hole transporting compound, the compound represented by the formula (2) and the compound represented by the formula (4), which were used in Example 15, were changed to the compounds shown in Table 1 and the coating liquid for the surface layer was prepared.

Example 20

An electrophotographic photosensitive member was produced in the same way as in Example 7, except that the compound represented by the formula (4-7), which was used in Example 7, was changed to a compound represented by the formula (4-17) and a coating liquid for the surface layer was prepared.

Comparative Example 1

An electrophotographic photosensitive member was produced in the same way as in Example 3, except that a coating liquid for the surface layer was prepared without addition of the compound represented by the above described formula (1-7), which was used in Example 3.

Comparative Example 2

An electrophotographic photosensitive member was produced in the same way as in Example 3, except that instead of the compound represented by the above described formula (1-7), which was used in Example 3, 0.200 parts of a compound represented by the following formula (B) was added and a coating liquid for the surface layer was prepared.

$$H_3C(CH_2)_{11}—CH_3 \quad (B)$$

Comparative Example 3

An electrophotographic photosensitive member was produced in the same way as in Example 3, except that the amount of the compound represented by the above described formula (1-7), which was adjusted in Example 3, was changed to 0.500 parts and a coating liquid for the surface layer was prepared.

Comparative Example 4

An electrophotographic photosensitive member was produced in the same way as in Example 3, except that the compounds represented by the above described formula (1-7) and the above described formula (3-7), which were used in Example 3, were changed to 0.200 parts of a compound represented by the following formula (C) and 2.0 parts of a compound represented by the following formula (D), respectively, and a coating liquid for the surface layer was prepared.

$$H_3C—(CH_2)_5—COOH \quad (C)$$

$$H_3C—(CH_2)_5—\overset{\overset{\displaystyle O}{\|}}{C}—O—CH{=}CH_2 \quad (D)$$

Comparative Example 5

An electrophotographic photosensitive member was produced in the same way as in Example 1, except that a coating liquid for the surface layer was prepared without addition of the compound represented by the above described formula (1-6), which was used in Example 1.

Comparative Example 6

An electrophotographic photosensitive member was produced in the same way as in Example 7, except that a coating liquid for the surface layer was prepared without addition of the compound represented by the above described formula (2-7), which was used in Example 7.

Comparative Example 7

An electrophotographic photosensitive member was produced in the same way as in Example 7, except that instead of the compound represented by the above described formula (2-7), which was used in Example 7, 0.200 parts of the compound represented by the above described formula (B) was added and a coating liquid for the surface layer was prepared.

Comparative Example 8

An electrophotographic photosensitive member was produced in the same way as in Example 7, except that the amount of the compound represented by the above described formula (2-7), which was adjusted in Example 7, was changed to 0.500 parts and a coating liquid for the surface layer was prepared.

Comparative Example 9

An electrophotographic photosensitive member was produced in the same way as in Comparative Example 5, except that 0.200 parts of a compound represented by the following formula (E) was added to the coating liquid which was used in Comparative Example 5 and a coating liquid for the surface layer was prepared.

$$H_3C—(CH_2)_5—OH \quad (E)$$

Comparative Example 10

An electrophotographic photosensitive member was produced in the same way as in Example 1, except that the coating liquid for the surface layer, which was prepared in Example 1, was changed in the following way.

The coating liquid for the surface layer was prepared, by mixing 50.0 parts of the hole transporting compound represented by the formula (a-10), 2.0 parts of the compound represented by the formula (4-1), and 50.0 parts of the compound represented by the formula (6-1), with 180 parts of isopropanol and 20 parts of tetrahydrofuran.

Comparative Example 11

An electrophotographic photosensitive member was produced in the same way as in Comparative Example 10, except that 0.100 parts of the compound represented by the above described formula (B) was added to the coating liquid which was used in Comparative Example 10 and a coating liquid for the surface layer was prepared.

Comparative Example 12

An electrophotographic photosensitive member was produced in the same way as in Comparative Example 10, except that 0.250 parts of the compound represented by the above described formula (2-1) was added to the coating liquid which was used in Comparative Example 10 and a coating liquid for the surface layer was prepared.

Comparative Example 13

An electrophotographic photosensitive member was produced in the same way as in Comparative Example 11, except that the compounds represented by the above described formula (B) and the above described formula (4-1), which were used in Comparative Example 11, were changed to 0.100 parts of a compound represented by the following formula (E) and 2.0 parts of the compound represented by the above described formula (F), respectively, and a coating liquid for the surface layer was prepared.

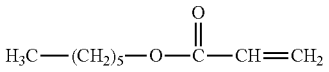

(F)

Comparative Example 14

An electrophotographic photosensitive member was produced in the same way as in Comparative Example 10, except that a coating liquid for the surface layer was prepared without addition of the compound represented by the above described formula (4-1), which was used in Comparative Example 10.

Comparative Example 15

An electrophotographic photosensitive member was produced in the same way as in Example 1, except that the coating liquid for the surface layer, which was prepared in Example 1, was changed in the following way.

The coating liquid for the surface layer was prepared, by mixing 50.0 parts of a hole transporting compound represented by the formula (9-4), 2.0 parts of the compound represented by the formula (4-1), 50.0 parts of trimethylolpropane triacrylate (trade name: KAYARAD TMPTA, manufactured by Nippon Kayaku Co., Ltd.), and 1 part of Irgacure 184 (1-hydroxycyclohexyl phenyl ketone) (manufactured by Ciba Specialty Chemicals), which functions as a photopolymerization initiator, with 500 parts of tetrahydrofuran.

Comparative Example 16

An electrophotographic photosensitive member was produced in the same way as in Comparative Example 15, except that 0.100 parts of the compound represented by the above described formula (B) was added to the coating liquid which was used in Comparative Example 15 and a coating liquid for the surface layer was prepared.

Comparative Example 17

An electrophotographic photosensitive member was produced in the same way as in Comparative Example 15, except that 0.250 parts of the compound represented by the above described formula (2-1) was added to the coating liquid which was used in Comparative Example 15 and a coating liquid for the surface layer was prepared.

Comparative Example 18

An electrophotographic photosensitive member was produced in the same way as in Comparative Example 15, except that instead of adding the compound represented by the above described formula (4-1), which was used in Comparative Example 15, 0.100 parts of the compound represented by the above described formula (E) and 2.0 parts of the compound represented by the above described formula (F) were added and a coating liquid for the surface layer was prepared.

Comparative Example 19

An electrophotographic photosensitive member was produced in the same way as in Comparative Example 15, except that a coating liquid for the surface layer was prepared without addition of the compound represented by the above described formula (4-1), which was used in Comparative Example 15.

TABLE 1

| | Compound of formula (1) or formula (2) | | | | | | | | |
|---|---|---|---|---|---|---|---|---|---|
| | Hole transporting compound | | | | Ratio to hole transporting | Compound of formula (3) or formula (4) | | Compound of formula (5) or formula (6) | |
| | Compound | Part | Compound | Part | compound (ppm) | Compound | Part | Compound | Part |
| Example 1 | (a-10) | 100.0 | (1-6) | 0.400 | 4000 | None | | | |
| Example 2 | (a-10) | 100.0 | (2-6) | 0.400 | 4000 | | | | |
| Example 3 | (a-10) | 100.0 | (1-7) | 0.200 | 2000 | (3-7) | 2.0 | | |
| Example 4 | (a-10) | 100.0 | (1-14) | 0.0500 | 500 | (3-14) | 2.0 | | |
| Example 5 | (a-10) | 100.0 | (2-1) | 0.200 | 2000 | (4-1) | 2.0 | | |
| Example 6 | (a-10) | 100.0 | (2-1) | 0.300 | 3000 | (4-1) | 2.0 | | |
| Example 7 | (a-10) | 100.0 | (2-7) | 0.300 | 3000 | (4-7) | 2.0 | | |
| Example 8 | (9-3) | 50.0 | (2-7) | 0.125 | 2500 | (4-7) | 2.0 | (5-1) | 50.0 |
| Example 9 | (9-3) | 50.0 | (2-14) | 0.0025 | 50 | (4-14) | 2.0 | (5-1) | 50.0 |

TABLE 1-continued

| | Compound of formula (1) or formula (2) | | | | | Compound of formula (3) or formula (4) | | Compound of formula (5) or formula (6) | |
|---|---|---|---|---|---|---|---|---|---|
| | Hole transporting compound | | | | Ratio to hole transporting | | | | |
| | Compound | Part | Compound | Part | compound (ppm) | Compound | Part | Compound | Part |
| Example 10 | (9-4) | 50.0 | (2-7) | 0.125 | 2500 | (4-7) | 2.0 | (5-1) | 50.0 |
| Example 11 | (9-3) | 50.0 | (2-7) | 0.125 | 2500 | (4-7) | 2.0 | (6-1) | 50.0 |
| Example 12 | (9-3) | 50.0 | (2-7) | 0.125 | 2500 | (4-7) | 2.0 | (5-1) | 50.0 |
| Example 13 | (9-4) | 50.0 | (2-7) | 0.125 | 2500 | (4-7) | 2.0 | (6-1) | 50.0 |
| Example 14 | (a-10) | 50.0 | (2-7) | 0.125 | 2500 | (4-7) | 2.0 | (6-1) | 50.0 |
| Example 15 | (9-4) | 50.0 | (2-7) | 0.100 | 2000 | (4-7) | 2.0 | | |
| Example 16 | (9-4) | 50.0 | (2-1) | 0.100 | 2000 | (4-1) | 2.0 | | |
| Example 17 | (a-14) | 50.0 | (2-7) | 0.100 | 2000 | (4-7) | 2.0 | | |
| Example 18 | (a-10) | 50.0 | (2-1) | 0.100 | 2000 | (4-1) | 2.0 | (6-1) | 50.0 |
| Example 19 | (9-4) | 50.0 | (2-1) | 0.100 | 2000 | (4-1) | 2.0 | | |
| Example 20 | (a-10) | 100.0 | (2-7) | 0.300 | 3000 | (4-17) | 2.0 | | |
| Comparative Example 1 | (a-10) | 100.0 | | | | (3-7) | 2.0 | | |
| Comparative Example 2 | (a-10) | 100.0 | | | | (3-7) | 2.0 | | |
| Comparative Example 3 | (a-10) | 100.0 | (1-7) | 0.500 | 5000 | (3-7) | 2.0 | | |
| Comparative Example 4 | (a-10) | 100.0 | | | | | | | |
| Comparative Example 5 | (a-10) | 100.0 | | | | | | | |
| Comparative Example 6 | (a-10) | 100.0 | | | | (4-7) | 2.0 | | |
| Comparative Example 7 | (a-10) | 100.0 | | | | (4-7) | 2.0 | | |
| Comparative Example 8 | (a-10) | 100.0 | (2-7) | 0.500 | 5000 | (4-7) | 2.0 | | |
| Comparative Example 9 | (a-10) | 100.0 | | | | | | | |
| Comparative Example 10 | (a-10) | 50.0 | | | | (4-1) | 2.0 | (6-1) | 50.0 |
| Comparative Example 11 | (a-10) | 50.0 | | | | (4-1) | 2.0 | (6-1) | 50.0 |
| Comparative Example 12 | (a-10) | 50.0 | (2-1) | 0.250 | 5000 | (4-1) | 2.0 | (6-1) | 50.0 |
| Comparative Example 13 | (a-10) | 50.0 | | | | | | (6-1) | 50.0 |
| Comparative Example 14 | (a-10) | 50.0 | | | | | | (6-1) | 50.0 |
| Comparative Example 15 | (9-4) | 50.0 | | | | (4-1) | 2.0 | | |
| Comparative Example 16 | (9-4) | 50.0 | | | | (4-1) | 2.0 | | |
| Comparative Example 17 | (9-4) | 50.0 | (2-1) | 0.250 | 5000 | (4-1) | 2.0 | | |
| Comparative Example 18 | (9-4) | 50.0 | | | | | | | |
| Comparative Example 19 | (9-4) | 50.0 | | | | | | | |

(Evaluation Method)

Electrical characteristics and abrasion resistance of the electrophotographic photosensitive members which were prepared in Examples 1 to 20 and Comparative Examples 1 to 19 were evaluated in the following way.

(Evaluation of Electrical Characteristics)

As an evaluation apparatus, an altered machine of a copier (trade name: iR-ADV C5051, manufactured by Canon Inc.), which is an electrophotographic apparatus, was used. As for an altered point, the process speed was altered to 450 mm/sec, and as for the charging unit, a method of applying a voltage such that an AC voltage was superimposed on a DC voltage to a charging roller was used. The electrophotographic photosensitive member produced in each of Examples was mounted to the drum cartridge for this evaluation apparatus, and the electrical characteristics were evaluated in the following way.

Conditions on the applied voltage and the light amount of exposure light of the exposure apparatus were set so that an initial dark part potential (Vd) of the electrophotographic photosensitive member became approximately −900 [V] and an initial bright part potential (Vl) became approximately −200 [V].

The surface potential of the electrophotographic photosensitive member was measured by using a surface potential meter (model 344: manufactured by Trek, INC.), after operations of: demounting a cartridge for development from the evaluation apparatus; and fixing a potential probe (trade name: model 6000B-8, manufactured by Trek Corp.) there.

Next, the electrophotographic photosensitive member was left for 24 hours in a low temperature and low humidity environment of a temperature of 20° C. and a humidity of 20% RH. Thereafter, the electrophotographic photosensitive member was mounted on the drum cartridge, this drum cartridge was mounted on the above described evaluation apparatus, and images having an image printing ratio of 5% were printed out on 5000 sheets of A4-size plain paper (in other words, the electrophotographic photosensitive member was repeatedly used while sheets were fed).

After the images of 5000 sheets were output, the cartridge for development was replaced with a potential measurement apparatus including the above described potential probe and surface potential meter, and the bright part potential (Vlab) of the surface of the electrophotographic photosensitive member after the images of 5000 sheets were output (after repeated use) was measured. Then, a variation amount ΔVla ($\Delta Vla=|Vlab|-|Vlaa|$) of the bright part potential of the surface of the electrophotographic photosensitive member during the repeated use was calculated. Here, Vlaa is the bright part potential of the surface of the electrophotographic photosensitive member before the repeated use (initial stage). In addition, |Vlab| and |Vlaa| represent absolute values of Vlab and Vlaa, respectively. The obtained evaluation results are shown in Table 2.

(Evaluation of Abrasion Resistance)

The obtained electrophotographic photosensitive member was mounted to a cyan station of an altered machine of an electrophotographic apparatus (copier) (trade name: iR-ADV C5051) manufactured by Canon Inc., which was the evaluation apparatus, in a low temperature and low humidity environment at a temperature of 20° C. and a humidity of 20% RH. Thereafter, images having an image printing ratio of 5% were continuously formed on 100000 sheets of A4-size plain paper. Film thickness of the surface layer of the electrophotographic photosensitive member after the end of image formation was measured, and a difference between the film thickness and a film thickness of the surface layer before image output was calculated as the amount of a scraped surface layer.

The obtained evaluation results are shown in Table 2.

TABLE 2

| | ΔVla (V) | Amount of scrape (μm) | | ΔVla (V) | Amount of scrape (μm) |
|---|---|---|---|---|---|
| Example 1 | 40 | 0.4 | Comparative Example 1 | 50 | 0.5 |
| Example 2 | 40 | 0.4 | Comparative Example 2 | 50 | 0.5 |
| Example 3 | 20 | 0.5 | Comparative Example 3 | 50 | 0.8 |
| Example 4 | 20 | 0.5 | Comparative Example 4 | 55 | 0.5 |
| Example 5 | 35 | 0.5 | Comparative Example 5 | 55 | 0.4 |
| Example 6 | 30 | 0.5 | Comparative Example 6 | 50 | 0.5 |
| Example 7 | 30 | 0.5 | Comparative Example 7 | 50 | 0.5 |
| Example 8 | 5 | 0.2 | Comparative Example 8 | 50 | 0.8 |
| Example 9 | 5 | 0.2 | Comparative Example 9 | 55 | 0.5 |
| Example 10 | 10 | 0.2 | Comparative Example 10 | 55 | 0.5 |
| Example 11 | 5 | 0.3 | Comparative Example 11 | 50 | 0.5 |
| Example 12 | 10 | 0.3 | Comparative Example 12 | 55 | 0.8 |
| Example 13 | 15 | 0.4 | Comparative Example 13 | 60 | 0.5 |
| Example 14 | 20 | 0.4 | Comparative Example 14 | 60 | 0.4 |
| Example 15 | 15 | 0.5 | Comparative Example 15 | 50 | 0.6 |
| Example 16 | 20 | 0.5 | Comparative Example 16 | 50 | 0.5 |
| Example 17 | 20 | 0.5 | Comparative Example 17 | 50 | 1 |
| Example 18 | 25 | 0.5 | Comparative Example 18 | 55 | 0.6 |
| Example 19 | 20 | 0.6 | Comparative Example 19 | 55 | 0.5 |
| Example 20 | 30 | 0.5 | | | |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-155635, filed Aug. 10, 2017, which is hereby incorporated by reference herein in its entirety.

What is claimed is:

1. An electrophotographic photosensitive member having a support, a charge generation layer, a charge transport layer and a surface layer in the listed order, wherein the surface layer comprises a cured product and a compound represented by formula (1) or (2):

$$H_3C—(CH_2)_a—COOH \quad (1)$$

$$H_3C—(CH_2)_b—OH \quad (2)$$

wherein in the formula (1), a is an integer of 6 or more; and in the formula (2), b is an integer of 6 or more;

the cured product is a polymerized product of a hole transporting compound having an acryloyloxy group or a methacryloyloxy group; and the compound represented by the formula (1) or (2) is contained in an amount of 50 to 4000 ppm with respect to the hole transporting compound having an acryloyloxy group or a methacryloyloxy group.

2. The electrophotographic photosensitive member according to claim 1, wherein the surface layer comprises a cured product and the compound represented by the formula (1);

the cured product is a copolymerized product of a hole transporting compound having an acryloyloxy group or a methacryloyloxy group, and a compound represented by the following formula (3); and the compound represented by the formula (1) is contained in an amount of 50 to 4000 ppm with respect to the hole transporting compound having an acryloyloxy group or a methacryloyloxy group:

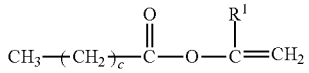

(3)

wherein in the formula (3), $R^1$ is a hydrogen atom or a methyl group, and c is an integer of 6 or more.

3. The electrophotographic photosensitive member according to claim 1, wherein the surface layer comprises a cured product and the compound represented by the formula (2);

the cured product is a copolymerized product of a hole transporting compound having an acryloyloxy group or a methacryloyloxy group, and a compound represented by the following formula (4); and the compound represented by the formula (2) is contained in an amount of 50 to 4000 ppm with respect to the hole transporting compound having an acryloyloxy group or a methacryloyloxy group:

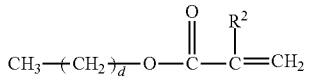

(4)

wherein in the formula (4), $R^2$ is a hydrogen atom or a methyl group, and d is an integer of 6 or more.

4. The electrophotographic photosensitive member according to claim 3, wherein b in the formula (2) is an integer of 12 or more.

5. The electrophotographic photosensitive member according to claim 4, wherein the charge transport layer comprises a compound represented by the following formula (10):

(10)

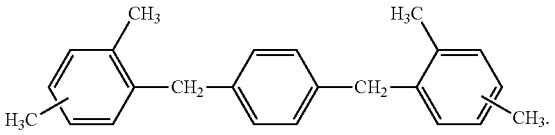

6. The electrophotographic photosensitive member according to claim 3, wherein the surface layer comprises a cured product and the compound represented by the formula (2);

the cured product is a copolymerized product of a hole transporting compound having an acryloyloxy group or a methacryloyloxy group, the compound represented by the formula (4), and a compound represented by the following formula (5) or the following formula (6); and the compound represented by the formula (2) is contained in an amount of 50 to 4000 ppm with respect to the hole transporting compound having an acryloyloxy group or a methacryloyloxy group:

(5)

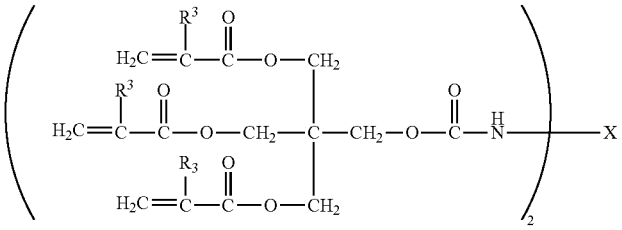

(6)

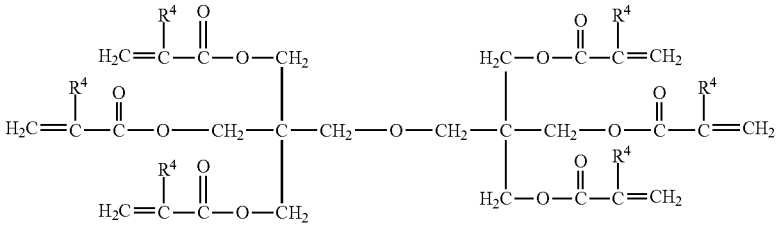

wherein in the formula (5), $R^3$ is a hydrogen atom or a methyl group, and X is an alkylene group having 13 or less carbon atoms; and in the formula (6), $R^4$ is a hydrogen atom or a methyl group.

7. The electrophotographic photosensitive member according to claim 6, wherein X in the formula (5) is an alkylene group represented by the following formula (7):

(7)

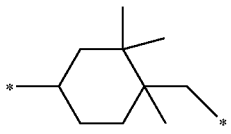

wherein in the formula (7), * represents a linking group.

8. The electrophotographic photosensitive member according to claim 3, wherein the surface layer comprises a cured product and the compound represented by the formula (2);

the cured product is a copolymerized product of a hole transporting compound having an acryloyloxy group or a methacryloyloxy group represented by the following formula (8), and the compound represented by the formula (4); and the compound represented by the formula (2) is contained in an amount of 50 to 4000 ppm with respect to the hole transporting compound having an acryloyloxy group or a methacryloyloxy group:

(8)

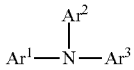

wherein in the formula (8), $Ar^1$ is a phenyl group substituted with a hydroxyl group or a hydroxyalkyl group, $Ar^2$ is a phenyl group substituted with an acryloyloxy group or a methacryloyloxy group, and $Ar^3$ is a phenyl group which is unsubstituted or is substituted with an alkyl group.

9. The electrophotographic photosensitive member according to claim 8, wherein the hole transporting compound having an acryloyloxy group or a methacryloyloxy group represented by the formula (8) is a hole transporting compound having an acryloyloxy group or a methacryloyloxy group represented by the following formula (9):

(9)

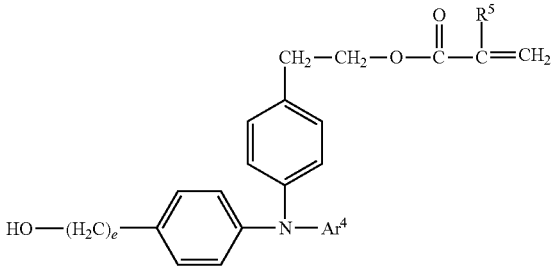

wherein in the formula (9), $R^5$ is a hydrogen atom or a methyl group, $Ar^4$ is a phenyl group or a tolyl group, and e is an integer of 1 or more.

10. A production method of an electrophotographic photosensitive member having a support, a charge generation layer, a charge transport layer and a surface layer in the listed order, the production method comprising:

preparing a coating liquid for a surface layer, which contains a hole transporting compound having an acryloyloxy group or a methacryloyloxy group, and a compound represented by formula (1) or (2) in an amount of 50 to 4000 ppm based on a total solid content in the coating liquid:

$$H_3C—(CH_2)_a—COOH \quad (1)$$

$$H_3C—(CH_2)_b—OH \quad (2)$$

wherein in the formula (1), a is an integer of 6 or more; and in the formula (2), b is an integer of 6 or more;

forming a coating film of the coating liquid for the surface layer; and curing the coating film to thereby form the surface layer of the electrophotographic photosensitive member.

11. A process cartridge integrally supporting an electrophotographic photosensitive member having a support, a charge generation layer, a charge transport layer and a surface layer in the listed order, with at least one unit selected from the group consisting of a charging unit, a developing unit, a transfer unit and a cleaning unit, and being detachably attachable to a main body of an electrophotographic apparatus, wherein the surface layer comprises a cured product and a compound represented by formula (1) or (2):

$$H_3C—(CH_2)_a—COOH \quad (1)$$

$$H_3C—(CH_2)_b—OH \quad (2)$$

wherein in the formula (1), a is an integer of 6 or more; and in the formula (2), b is an integer of 6 or more;

the cured product is a polymerized product of a hole transporting compound having an acryloyloxy group or a methacryloyloxy group; and the compound represented by the formula (1) or (2) is contained in an amount of 50 to 4000 ppm with respect to the hole transporting compound having an acryloyloxy group or a methacryloyloxy group.

12. An electrophotographic apparatus comprising: an electrophotographic photosensitive member having a support, a charge generation layer, a charge transport layer and a surface layer in the listed order; and a charging unit, an exposure unit, a developing unit and a transfer unit, wherein the surface layer comprises a cured product and a compound represented by formula (1) or (2):

$$H_3C—(CH_2)_a—COOH \quad (1)$$

$$H_3C—(CH_2)_b—OH \quad (2)$$

wherein in the formula (1), a is an integer of 6 or more; and in the formula (2), b is an integer of 6 or more;

the cured product is a polymerized product of a hole transporting compound having an acryloyloxy group or a methacryloyloxy group; and the compound represented by the formula (1) or (2) is contained in an amount of 50 to 4000 ppm with respect to the hole transporting compound having an acryloyloxy group or a methacryloyloxy group.

* * * * *